US011016422B2

(12) United States Patent
Takahashi et al.

(10) Patent No.: US 11,016,422 B2
(45) Date of Patent: May 25, 2021

(54) ATTACHMENT, FIXING DEVICE, AND IMAGE FORMING APPARATUS

(71) Applicants: Yoshiharu Takahashi, Tokyo (JP); Hiroshi Kajiyama, Tokyo (JP)

(72) Inventors: Yoshiharu Takahashi, Tokyo (JP); Hiroshi Kajiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/880,577

(22) Filed: May 21, 2020

(65) Prior Publication Data

US 2021/0003946 A1 Jan. 7, 2021

(30) Foreign Application Priority Data

Jul. 5, 2019 (JP) ..... JP2019-126525

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS 5,161,796 A * 11/1992 Okamoto ..... G03G 15/6532 271/308
9,031,483 B2 * 5/2015 Yamamoto ..... G03G 15/2028 399/323
2009/0110452 A1 4/2009 Ogata
2020/0033764 A1 1/2020 Kajiyama et al.

FOREIGN PATENT DOCUMENTS

JP 2007-047381 2/2007
JP 2009-109574 5/2009
JP 2012-215793 11/2012

OTHER PUBLICATIONS

U.S. Appl. No. 16/811,955, filed Mar. 6, 2020 Yoshiharu Takahashi, et al.

* cited by examiner

*Primary Examiner* — Clayton E. LaBalle
*Assistant Examiner* — Michael A Harrison
(74) *Attorney, Agent, or Firm* — Oblon, McClelland, Maier & Neustadt, L.L.P.

(57) ABSTRACT

An attachment is attached to a holding shaft and includes a first hollow axial portion including a first slit that receives the holding shaft. A supplemental member includes a second hollow axial portion including a second slit that receives the holding shaft. The supplemental member rotates in a forward direction and a backward direction. A restrictor restricts rotation of the supplemental member in the forward direction and the backward direction in a state in which the first slit and the second slit receive the holding shaft.

19 Claims, 9 Drawing Sheets

ATTACHMENT, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-126525, filed on Jul. 5, 2019, in the Japan Patent Office, the entire disclosure of which is hereby incorporated by reference herein.

BACKGROUND

Technical Field

Exemplary aspects of the present disclosure relate to an attachment, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that includes an attachment. The attachment includes a first hollow axial portion including a first slit and is added with a supplemental member that includes a second hollow axial portion including a second slit. The first slit and the second slit receive a holding shaft.

SUMMARY

This specification describes below an improved attachment. In one embodiment, the attachment is attached to a holding shaft and includes a first hollow axial portion including a first slit that receives the holding shaft. A supplemental member includes a second hollow axial portion including a second slit that receives the holding shaft. The supplemental member rotates in a forward direction and a backward direction. A restrictor restricts rotation of the supplemental member in the forward direction and the backward direction in a state in which the first slit and the second slit receive the holding shaft.

This specification further describes a fixing device. In one embodiment, the fixing device includes a holding shaft and a separator that is supported by the holding shaft. The separator includes a first hollow axial portion including a first slit that receives the holding shaft. A supplemental member includes a second hollow axial portion including a second slit that receives the holding shaft. The supplemental member rotates in a forward direction and a backward direction. A restrictor restricts rotation of the supplemental member in the forward direction and the backward direction in a state in which the first slit and the second slit receive the holding shaft.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
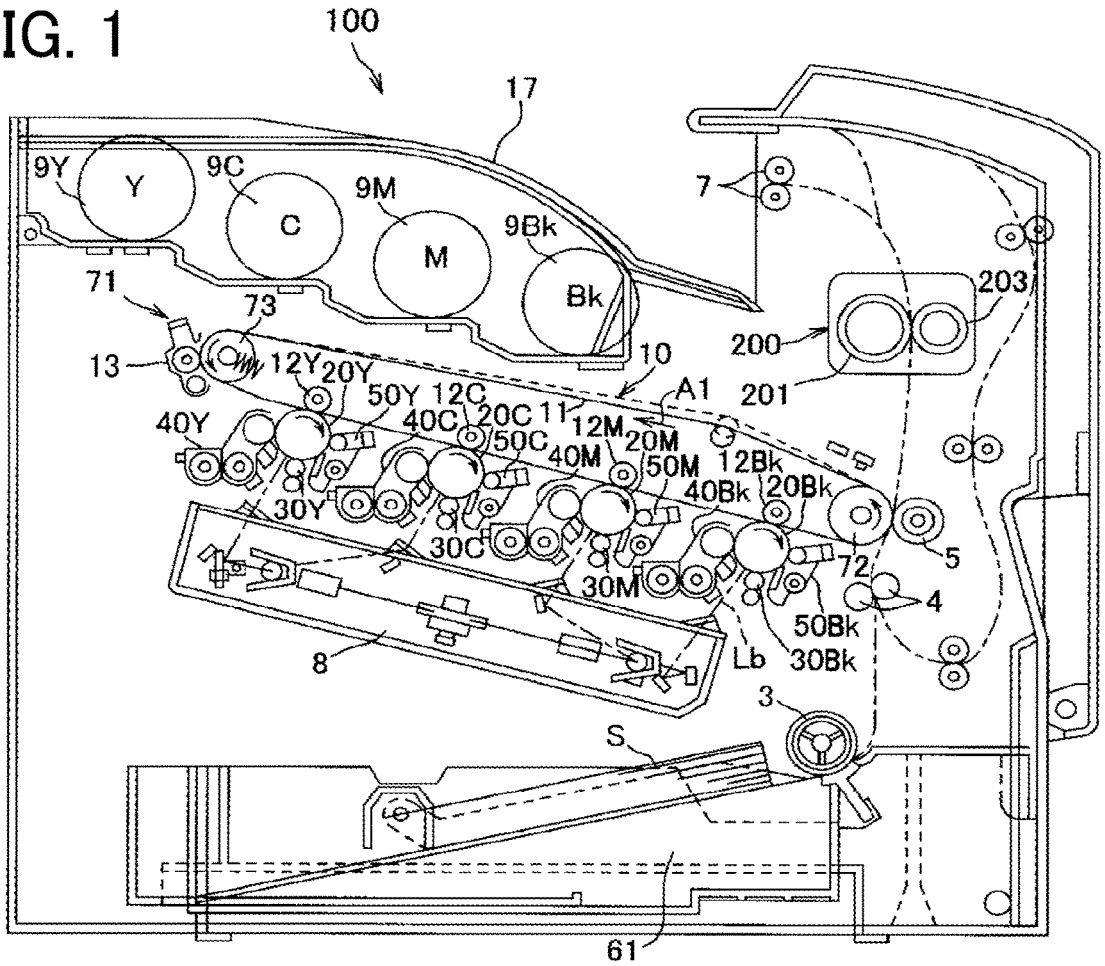
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

A description is provided of an embodiment of the present disclosure applied to a separator of a fixing device installed in an image forming apparatus.

FIG. 1 is a schematic cross-sectional view of an image forming apparatus 100 according to an embodiment of the present disclosure. The image forming apparatus 100 is a color printer employing a tandem system in which a plurality of image forming devices that forms images in a plurality of colors, respectively, is aligned in a stretch direction of a transfer belt 11. Alternatively, the image forming apparatus 100 may employ systems other than the tandem system. According to this embodiment, the image forming apparatus 100 is a printer. Alternatively, the image forming apparatus 100 may be a copier, a facsimile machine, or the like.

The image forming apparatus 100 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt that rotates in a direction A1 while the transfer belt 11 is disposed opposite the photoconductive drums 20Y, 20C, 20M, and 20Bk. In the primary transfer process, yellow, cyan, magenta, and black toner images are transferred onto the transfer belt 11 such that the yellow, cyan, magenta, and black toner images are superimposed on the transfer belt 11. Thereafter, the visible images formed on the transfer belt 11 are transferred collectively onto a recording medium S (e.g., a recording sheet) in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk that forms the black toner image as an example, a charger 30Bk, a developing device 40Bk, a primary transfer roller 12Bk, and a cleaner 50Bk which form the black toner image are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 8 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. The primary transfer rollers 12Y, 12C, 12M, and 12Bk disposed opposite the photoconductive drums 20Y, 20C, 20M, and 20Bk via the transfer belt 11 apply voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from upstream to downstream in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 5, a belt cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 is disposed opposite the transfer belt 11 and rotates in accordance with rotation of the transfer belt 11. The belt cleaner 13 is disposed opposite the transfer belt 11 and cleans the transfer belt 11. The optical writing device 8 is disposed opposite and below the four imaging stations.

The optical writing device 8 includes a semiconductor laser serving as a light source, a coupling lens, an f-θ lens, a toroidal lens, a reflection mirror, and a polygon mirror serving as a deflector. The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the light beam Lb directed to the imaging station that forms the black toner image, the light beams Lb are also directed to the imaging stations that form the yellow, cyan, and magenta toner images, respectively.

The image forming apparatus 100 further includes a sheet feeder 61, a registration roller pair 4, and a sensor. The sheet feeder 61 is a sheet feeding tray (e.g., a paper tray) that loads recording media S to be conveyed to a secondary transfer nip formed between the secondary transfer roller 5 and the transfer belt 11. The registration roller pair 4 feeds the recording medium S conveyed from the sheet feeder 61 to the secondary transfer nip formed between the secondary transfer roller 5 and the transfer belt 11 at a predetermined time when the yellow, cyan, magenta, and black toner images formed on the transfer belt 11 by the imaging stations reach the secondary transfer nip. The sensor detects that a leading edge of the recording medium S reaches the registration roller pair 4.

The image forming apparatus 100 further includes a fixing device 200, a sheet ejection roller pair 7, a sheet ejection tray 17, and toner bottles 9Y, 9C, 9M, and 9Bk. The fixing device 200 fixes a color toner image on the recording medium S. The color toner image is formed by transferring the yellow, cyan, magenta, and black toner images formed on the transfer belt 11 onto the recording medium S. The sheet ejection roller pair 7 ejects the recording medium S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording media S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped. The driven roller 73 also serves as a tension applicator that applies tension to the transfer belt 11. Hence, a biasing member such as a spring biases the driven roller 73 against the transfer belt 11. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording medium S. As the sheet feeding roller 3 is driven and rotated counterclockwise in FIG. 1, the sheet feeding roller 3 feeds the uppermost recording medium S to the registration roller pair 4.

The belt cleaner 13 installed in the transfer device 71 includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11. The belt cleaner 13 further includes a discharging device that conveys the residual toner removed from the transfer belt 11 for disposal.

A description is provided of a construction of the fixing device 200 incorporated in the image forming apparatus 100.

Figure 2:
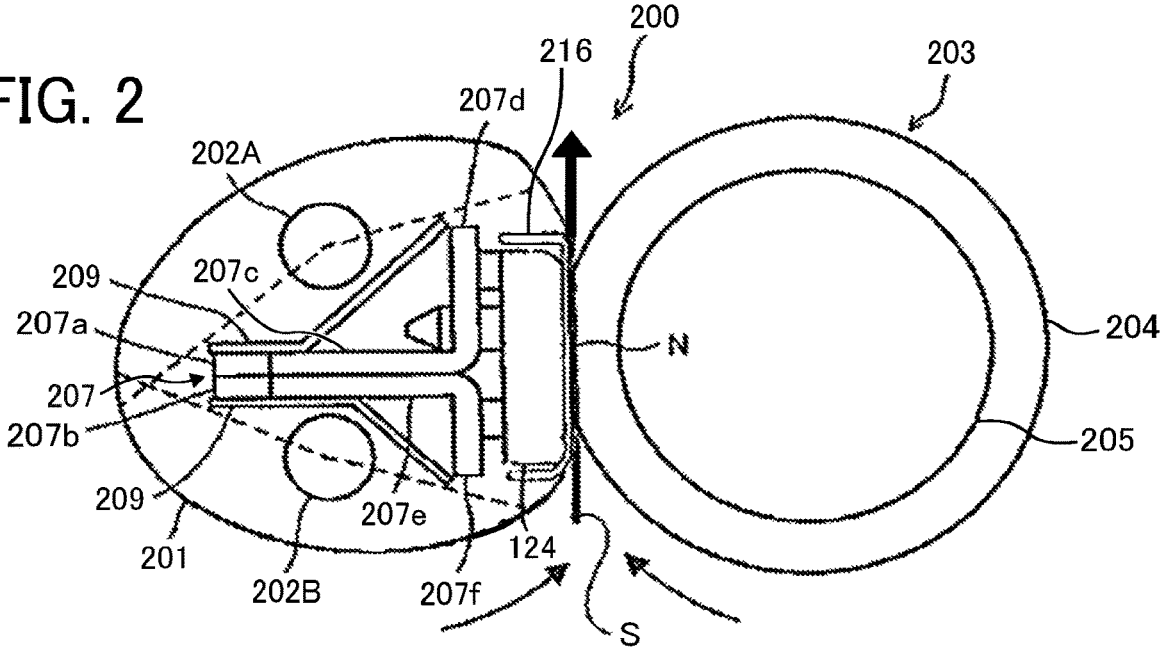
FIG. 2 is a schematic cross-sectional view of a fixing device incorporated in the image forming apparatus depicted in FIG. 1.

FIG. 2 is a schematic cross-sectional view of the fixing device 200. The fixing device 200 includes a fixing belt 201 and a pressure roller 203. The fixing belt 201 serves as a fixing rotator that is rotatable in a rotation direction indicated with an arrow in FIG. 2. The pressure roller 203 serves as a pressure rotator that is disposed opposite the fixing belt 201 and rotatable in a rotation direction indicated with an arrow in FIG. 2. Halogen heaters 202A and 202B serve as heat sources or heaters that are disposed opposite an inner circumferential surface of the fixing belt 201. The halogen heaters 202A and 202B heat the fixing belt 201 directly with radiant heat. The fixing device 200 incorporates a plurality of heaters (e.g., the halogen heaters 202A and 202B). Alternatively, the fixing device 200 may incorporate a single heater.

A nip formation pad 124 is disposed inside a loop formed by the fixing belt 201. The nip formation pad 124 presses against the pressure roller 203 via the fixing belt 201 to form a fixing nip N between the fixing belt 201 and the pressure roller 203. The inner circumferential surface of the fixing belt 201 slides over the nip formation pad 124 indirectly via a thermal equalizer 216. As a recording medium S bearing a toner image is conveyed through the fixing nip N, the fixing belt 201 and the pressure roller 203 fix the toner image on the recording medium S under heat and pressure.

The thermal equalizer 216 illustrated in FIG. 2 is planar. Alternatively, the thermal equalizer 216 may be curved or concave or may have other shapes. If the thermal equalizer 216 is concave to define the fixing nip N that is concave, the leading edge of the recording medium S is directed to the pressure roller 203 when the recording medium S is ejected from the fixing nip N, facilitating separation of the recording medium S from the fixing belt 201 and thereby preventing the recording medium S from being jammed.

Inside the loop formed by the fixing belt 201 are the nip formation pad 124, the thermal equalizer 216, and a stay 207. The nip formation pad 124 is disposed opposite the pressure roller 203 via the thermal equalizer 216 and the fixing belt 201. The thermal equalizer 216 covers an opposed face of the nip formation pad 124, that is disposed opposite the inner circumferential surface of the fixing belt 201. The stay 207 is constructed of stay portions 207*a*, 207*b*, 207*c*, 207*d*, 207*e*, and 207*f*. The stay 207 supports the nip formation pad 124 against pressure from the pressure roller 203. Each of the nip formation pad 124, the thermal equalizer 216, and the stay 207 has a length not smaller than a length of the fixing belt 201 in an axial direction, that is, a longitudinal direction, of the fixing belt 201.

The thermal equalizer 216 facilitates conduction of heat in a longitudinal direction thereof, suppressing temperature increase of both lateral ends of the fixing belt 201 in the longitudinal direction thereof when a plurality of small recording media S is conveyed through the fixing nip N and thereby decreasing unevenness of the temperature of the fixing belt 201 in the longitudinal direction thereof.

Hence, the thermal equalizer 216 is preferably made of a material that conducts heat in a shortened time period. For example, the thermal equalizer 216 is preferably made of a material having an increased thermal conductivity, such as copper, aluminum, and silver. Copper is most preferable by comprehensively considering costs, availability, thermal conductivity, and processing.

According to this embodiment, an opposed face of the thermal equalizer 216, that is disposed opposite the inner circumferential surface of the fixing belt 201, serves as a nip forming face that contacts the fixing belt 201 directly.

A detailed description is now given of a construction of the fixing belt 201.

The fixing belt 201 is an endless belt or film made of metal such as nickel and SUS stainless steel or resin such as polyimide. The fixing belt 201 includes a base layer and a release layer. The release layer serves as a surface layer made of perfluoroalkoxy alkane (PFA), polytetrafluoroethylene (PTFE), or the like, facilitating separation of the recording medium S from the fixing belt 201 and preventing toner from adhering to the fixing belt 201. Optionally, an elastic layer made of silicone rubber or the like may be interposed between the base layer and the release layer. If the fixing belt 201 does not incorporate the elastic layer, the fixing belt 201 attains a decreased thermal capacity that improves a fixing property of being heated quickly. However, when the pressure roller 203 presses and deforms an unfixed toner image to fix the toner image on the recording medium S, slight surface asperities of the fixing belt 201 may be transferred onto the toner image, causing a disadvantage that an orange peel mark remains on a solid part of the toner image as uneven gloss of the toner image or an orange peel image. To address this circumstance, the elastic layer has a thickness of 100 micrometers or more. As the elastic layer deforms, the elastic layer absorbs the slight surface asperities, preventing the orange peel mark on the toner image.

A detailed description is now given of a construction of the stay 207.

The stay 207 includes a base and an arm that projects from the base. The arm is disposed opposite the fixing nip N via the base. The halogen heater 202A serving as a fixing heater is disposed opposite the halogen heater 202B serving as another fixing heater via the arm. The halogen heaters 202A and 202B disposed opposite the inner circumferential surface of the fixing belt 201 heat the fixing belt 201 directly with radiant heat.

The nip formation pad 124 and the stay 207 serving as a support that supports the nip formation pad 124 to define the fixing nip N are disposed inside the loop formed by the fixing belt 201. The stay 207 prevents the nip formation pad 124 from being bent by pressure from the pressure roller 203, attaining a uniform length of the fixing nip N in a recording medium conveyance direction throughout an entire length of the fixing belt 201 in the axial direction thereof. Both lateral ends of the stay 207 in the axial direction of the fixing belt 201 are supported by and secured to flanges serving as holders, respectively, thus being positioned inside the loop formed by the fixing belt 201. The fixing device 200 further includes a reflector 209 interposed between the halogen heater 202A and the stay 207 and another reflector 209 interposed between the halogen heater 202B and the stay 207. The reflectors 209 reflect radiant heat and the like from the halogen heaters 202A and 202B, suppressing heating of the stay 207 with radiant heat and the like and resultant waste of energy. Instead of the reflectors 209, a surface of the stay 207 may be treated with thermal insulation or specular surface to attain similar advantages.

A detailed description is now given of a construction of the pressure roller 203.

The pressure roller 203 includes a core metal 205, an elastic rubber layer 204, and a release layer. The elastic rubber layer 204 is disposed on the core metal 205. The release layer serves as a surface layer that facilitates separation of the recording medium S from the pressure roller 203. The release layer is made of PFA, PTFE, or the like. A driving force is transmitted to the pressure roller 203 from a driver such as a motor disposed in the image forming apparatus 100 through a gear, thus rotating the pressure roller 203. A spring or the like presses the pressure roller 203 against the fixing belt 201. As the spring presses and deforms the elastic rubber layer 204, the pressure roller 203 forms the fixing nip N having a predetermined length in the recording medium conveyance direction. The pressure roller 203 may be a solid roller or a hollow roller. Alternatively, a heater such as a halogen heater may be disposed inside the pressure roller 203. The elastic rubber layer 204 may be made of solid rubber. Alternatively, if no heater is disposed inside the pressure roller 203, sponge rubber may be used. The sponge rubber enhances thermal insulation of the pressure roller 203, preferably causing the pressure roller 203 to draw less heat from the fixing belt 201.

The fixing belt 201 rotates in accordance with rotation of the pressure roller 203. With the construction of the fixing device 200 illustrated in FIG. 2, as the driver drives and rotates the pressure roller 203, the driving force is transmitted from the pressure roller 203 to the fixing belt 201 at the fixing nip N, rotating the fixing belt 201 in accordance with rotation of the pressure roller 203. The fixing belt 201 rotates while the nip formation pad 124 and the pressure roller 203 sandwich the fixing belt 201 at the fixing nip N. The fixing belt 201 rotates while flanges guide the fixing belt 201 at both lateral ends of the fixing belt 201 in the axial direction thereof in a circumferential span of the fixing belt 201 other than the fixing nip N. With the construction described above, the fixing device 200 attaining quick warmup is manufactured at reduced costs.

Figure 3:
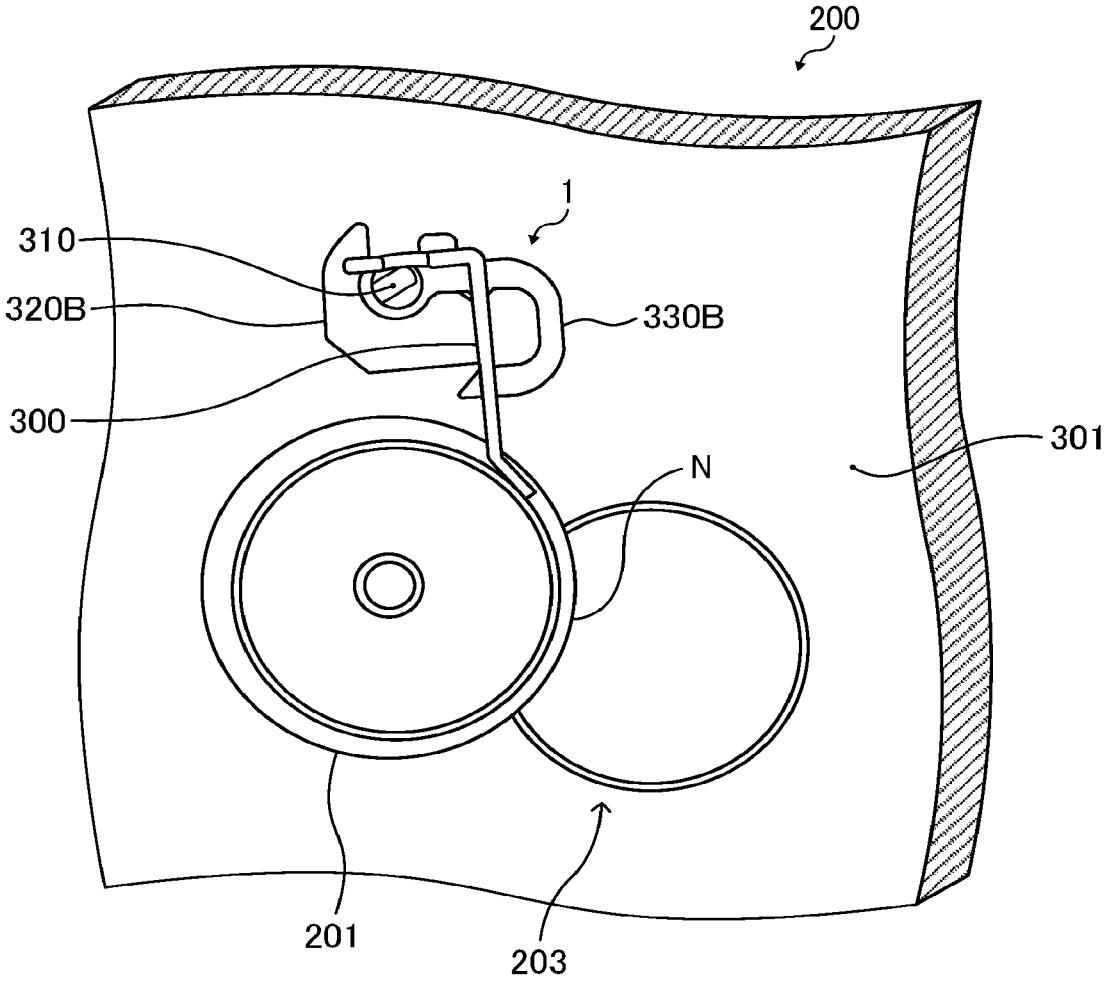
FIG. 3 is a diagram of the fixing device depicted in FIG. 2, illustrating a separation plate incorporated therein.

FIG. 3 is a diagram of a separation plate 300 incorporated in a separator 1 serving as an attachment, illustrating a position of the separation plate 300 in the fixing device 200. As illustrated in FIG. 3, the separation plate 300 is disposed downstream from and disposed above the fixing nip N formed between the fixing belt 201 and the pressure roller 203. The separation plate 300 separates the recording medium S that has passed through the fixing nip N from the fixing belt 201. FIG. 3 also illustrates a holding mechanism disposed at a rear of the fixing device 200. A holding pin 310 serving as a holding shaft is disposed on a face of a rear side plate 301, that faces a center of the fixing device 200. The holding pin 310 rotatably supports a mount 320B (e.g., a bracket) disposed at a rear of the separation plate 300 through a separation holder 330B serving as a supplemental member.

Figure 4:
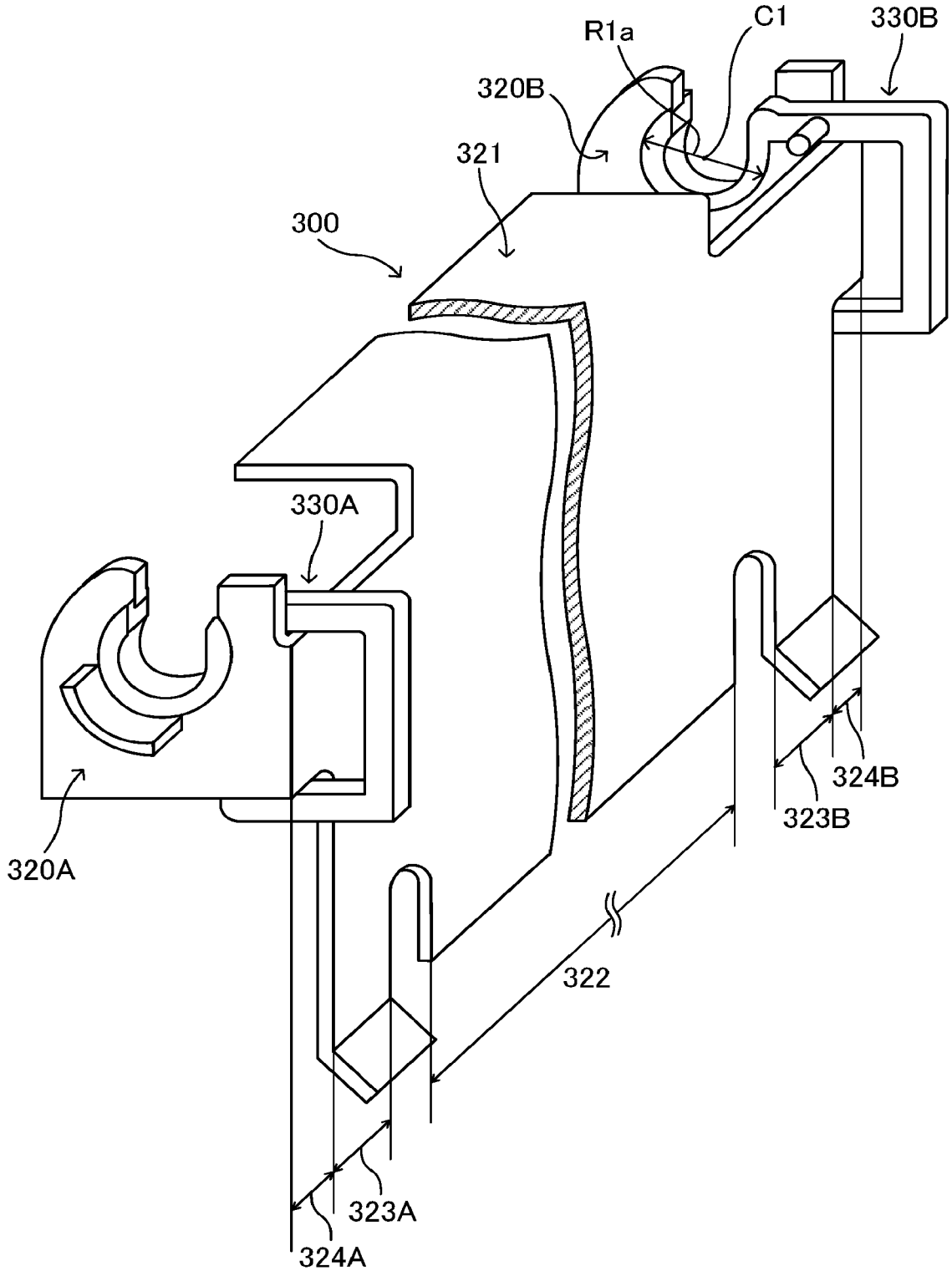
FIG. 4 is a perspective view of the separation plate depicted in FIG. 3 before being installed in the fixing device.

FIG. 4 is a perspective view of the separation plate 300 before being installed into the fixing device 200. The separation plate 300 includes a mount 320A (e.g., a bracket) disposed at a front of the fixing device 200 and the mount 320B disposed at the rear of the fixing device 200. The separation plate 300 further includes a bent portion 321 disposed at an upper portion of the separation plate 300. The bent portion 321 enhances the mechanical strength of the separation plate 300. The separation plate 300 further includes a separation plate portion 322, contact portions 323A and 323B, and couplers 324A and 324B. The separation plate portion 322 includes a front edge directed to the fixing belt 201. The contact portions 323A and 323B are disposed outboard from the separation plate portion 322 in a longitudinal direction of the separation plate 300 parallel to the axial direction of the fixing belt 201. The contact portions 323A and 323B position the separation plate 300 with respect to the fixing belt 201. The couplers 324A and 324B couple the contact portions 323A and 323B with the mounts 320A and 320B, respectively.

Figure 5:
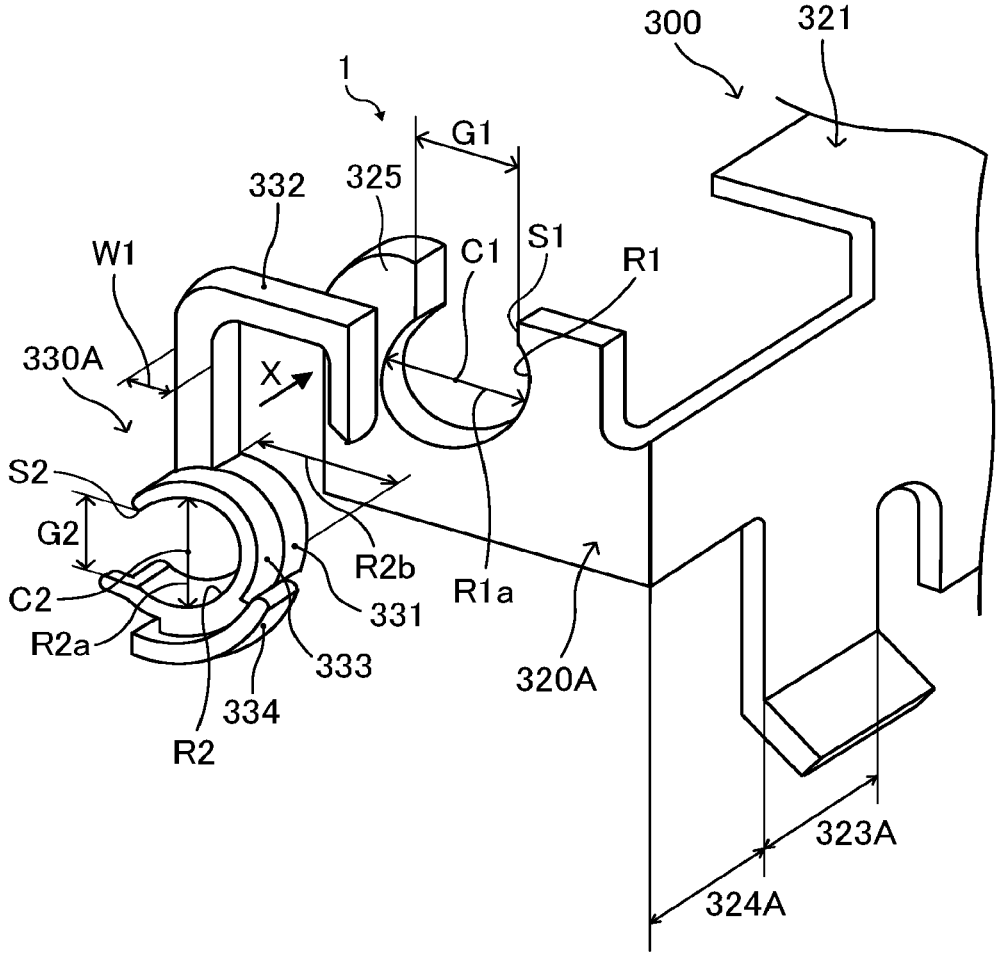
FIG. 5 is an enlarged view of a vicinity of a mount incorporated in the separation plate depicted in FIG. 4 and disposed at a front of the fixing device.

FIG. 5 is an enlarged view of a vicinity of the mount 320A disposed at the front of the fixing device 200. FIG. 5 is an exploded view of a separation holder 330A. The mount 320A includes a first hollow axial portion 325 including a through-hole R1 that defines a circle having a center C1 and a diameter R1*a* through the center C1. Amount wall disposed above the through-hole R1 is cut to produce a first slit S1 having a width G1, that is, a slit width, smaller than the diameter R1*a* of the through-hole R1.

The separation holder 330A includes a second hollow axial portion 331 including a second slit S2 having a width G2, that is, a slit width. The second hollow axial portion 331 includes a through-hole R2 having a diameter R2*a*. For example, each of the first hollow axial portion 325 and the second hollow axial portion 331 is a bearing, a hollow shaft, or the like.

The separation holder 330A further includes an arm 332 mounted on an outer circumferential surface of the second hollow axial portion 331 at a position of the separation holder 330A, that is closer to the center of the fixing device 200 in a longitudinal direction thereof. The arm 332 extends from the outer circumferential surface of the second hollow axial portion 331 in a diametrical direction defined by a center C2 of the second hollow axial portion 331. A flange 333 having an increased diameter is disposed at a position closer to the front of the fixing device 200 than the second hollow axial portion 331. For example, the flange 333 is disposed outboard from the second hollow axial portion 331 in the longitudinal direction of the separation plate 300. A cover 334 projects outboard beyond the flange 333 in an axial direction of the second hollow axial portion 331. The cover 334 covers a periphery of the holding pin 310.

A diameter R2*b* of an outer periphery of the second hollow axial portion 331 is smaller than the diameter R1*a* of the through-hole R1 of the first hollow axial portion 325. A width W1 of the arm 332 is smaller than the width G1 of the first slit S1. Accordingly, as illustrated in FIG. 5, the center C2 of the second hollow axial portion 331 overlaps the center C1 of the through-hole R1. A projecting portion of the arm 332, that projects from the second hollow axial portion 331 linearly, rotates to be parallel to the first slit S1. The second hollow axial portion 331 moves in a direction X. Thus, the second hollow axial portion 331 is inserted into the through-hole R1.

Figure 6A:
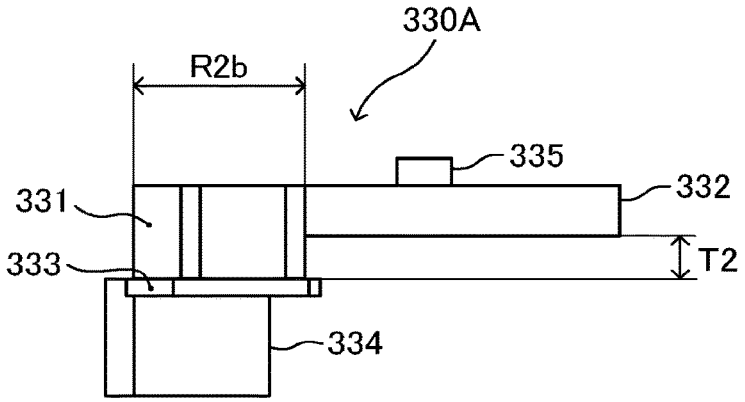
FIG. 6A is a plan view of a separation holder disposed at the front of the fixing device depicted in FIG. 2.
Figure 6B:
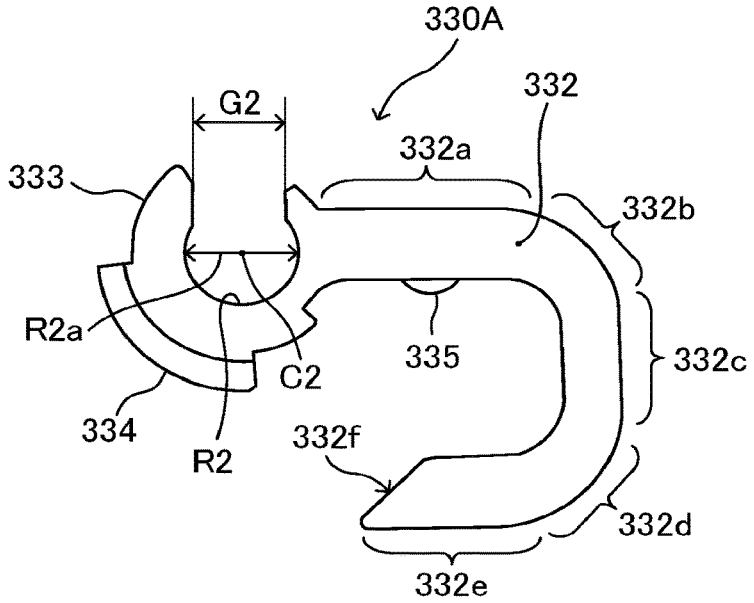
FIG. 6B is a front view of the separation holder depicted in FIG. 6A.
Figure 6C:
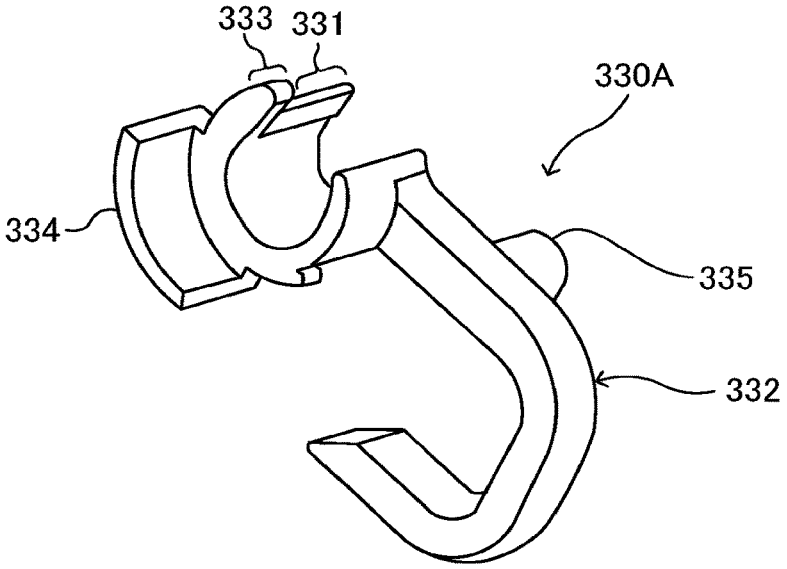
FIG. 6C is a perspective view of the separation holder depicted in FIG. 6A.

FIGS. 6A, 6B, and 6C illustrate the separation holder 330A disposed at the front of the fixing device 200. FIG. 6A is a plan view of the separation holder 330A. FIG. 6B is a front view of the separation holder 330A. FIG. 6C is a perspective view of the separation holder 330A. As illustrated in FIG. 6B, the arm 332 includes a first linear portion 332*a* that extends from the outer periphery of the second hollow axial portion 331 in the diametrical direction thereof, a first curved portion 332*b* contiguous to the first linear portion 332*a*, a second linear portion 332*c* contiguous to the first curved portion 332*b*, a second curved portion 332*d* contiguous to the second linear portion 332*c*, a third linear portion 332*e* contiguous to the second curved portion 332*d*, and a slope 332*f* disposed at a tip of the third linear portion 332*e*, that is, a tip of the arm 332. The first curved portion 332*b* and the second curved portion 332*d* are interposed between the first linear portion 332*a* and the third linear portion 332*e*. The first curved portion 332*b* is curved to define an angle of 90 degrees with respect to the first linear portion 332*a* and the second linear portion 332*c*. The second curved portion 332*d* is curved to define an angle of 90 degrees with respect to the second linear portion 332*c* and the third linear portion 332*e*.

The second hollow axial portion 331 of the separation holder 330B depicted in FIG. 4 is inserted into the through-hole R1 of the mount 320B of the separation plate 300 from the rear of the fixing device 200. Accordingly, the arm 332, the flange 333, and the cover 334 of the separation holder 330B are positioned with respect to the second hollow axial portion 331 symmetrically to those of the separation holder 330A disposed at the front of the fixing device 200 in a front-rear direction of the fixing device 200 (e.g., the axial direction of the second hollow axial portion 331).

Figure 7B:
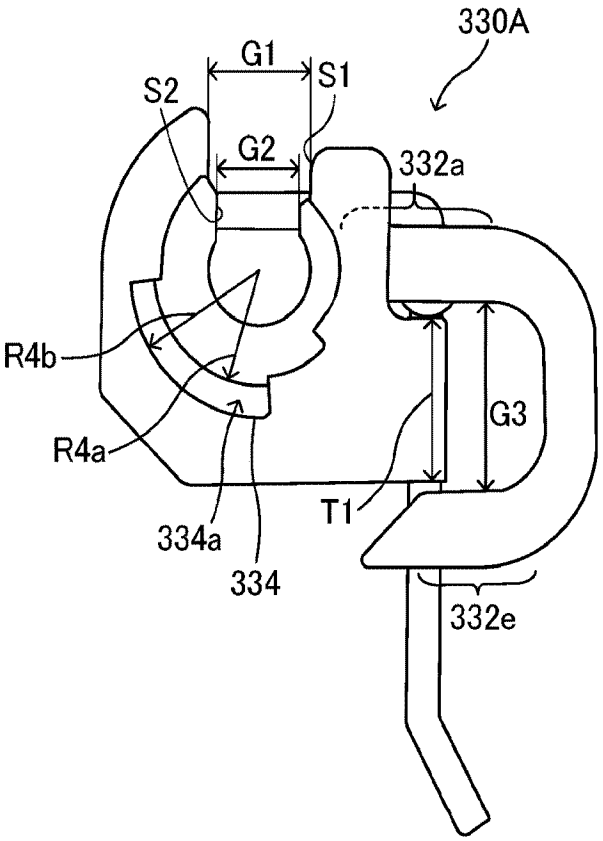
FIG. 7B is a diagram of the separation holder depicted in FIG. 6B, illustrating another process for installing the separation holder into the fixing device.
Figure 7A:
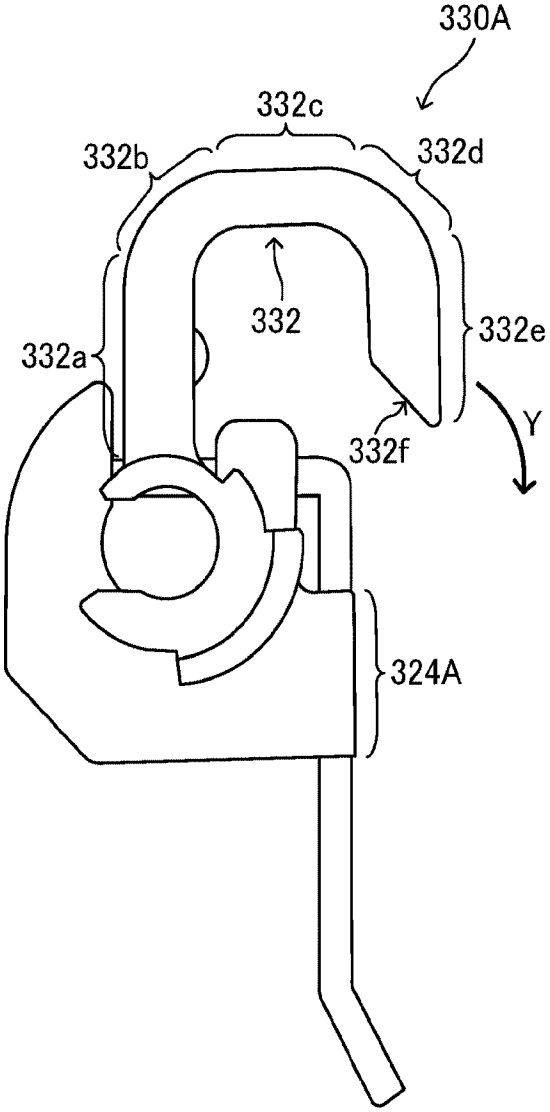
FIG. 7A is a diagram of the separation holder depicted in FIG. 6B, illustrating a process for installing the separation holder into the fixing device.

FIGS. 7A and 7B illustrate processes for attaching the separation holder 330A disposed at the front of the fixing device 200 as one example. FIG. 7A illustrates an insertion completion state in which insertion of the separation holder 330A is completed. FIG. 7B illustrates a rotation completion state in which rotation of the separation holder 330A is completed after insertion of the separation holder 330A is completed. As the separation holder 330A moves in the direction X depicted in FIG. 5, the second hollow axial portion 331 of the separation holder 330A is inserted in the through-hole R1 of the mount 320A in the insertion completion state. Accordingly, the arm 332 is disposed closer to the rear of the fixing device 200 than the mount 320A is. The flange 333 contacts a front face of the mount 320A.

In the insertion completion state, the second hollow axial portion 331 rotates inside the through-hole R1 such that the arm 332 moves in a direction Y illustrated in FIG. 7A to a position of the rotation completion state illustrated in FIG. 7B. As the arm 332 rotates about the through-hole R1, the slope 332*f* disposed at the tip of the arm 332 slides over and surmounts a face of the coupler 324A depicted in FIG. 5 of the separation plate 300. While the slope 332*f* slides over the coupler 324A, the second curved portion 332*d* and the first curved portion 332*b* of the arm 332 bend and surmount the face of the coupler 324A, moving to the position of the rotation completion state illustrated in FIG. 7B.

In the rotation completion state depicted in FIG. 7B after the third linear portion 332*e* surmounts the face of the coupler 324A, an interval G3 between the first linear portion 332*a* and the third linear portion 332*e* is substantially equivalent to a width T1 of the coupler 324A. Hence, the first linear portion 332*a* serving as a first restricting portion and the third linear portion 332*e* serving as a second restricting portion sandwich the coupler 324A. Accordingly, the third linear portion 332*e* contacts a lower end face of the coupler 324A, restricting rotation of the separation holder 330A about the through-hole R1 in either direction (e.g., the forward direction and the backward direction). For example, the arm 332 and the coupler 324A serve as a restrictor that restricts relative rotation of the separation holder 330A in either direction. For example, the tip of the arm 332 engages the coupler 324A to restrict rotation of the separation holder 330A. Thus, the separation holder 330A does not drop off.

Additionally, in the rotation completion state in which relative rotation of the separation holder 330A is restricted in both directions (e.g., the forward direction and the backward direction), as illustrated in FIG. 7B, the first slit S1 of the mount 320A overlaps the second slit S2 of the separation holder 330A. For example, opposed faces of the first slit S1, that are disposed opposite each other and define the width G1, are parallel to opposed faces of the second slit S2, that are disposed opposite each other and define the width G2, respectively. Since each of the opposed faces of the first slit S1 and the opposed faces of the second slit S2 is a plane, the opposed faces of the first slit S1 and the second slit S2 are parallel planes, respectively.

As illustrated in FIG. 6A, a front face of the arm 332 and a rear face of the flange 333 define a distance T2. The distance T2 may be equivalent to a plate thickness of the mount 320A. In this case, transition to the insertion completion state retains a state in which the separation holder 330A is attached to the mount 320A in an insertion direction in which the separation holder 330A is inserted.

Figure 8:
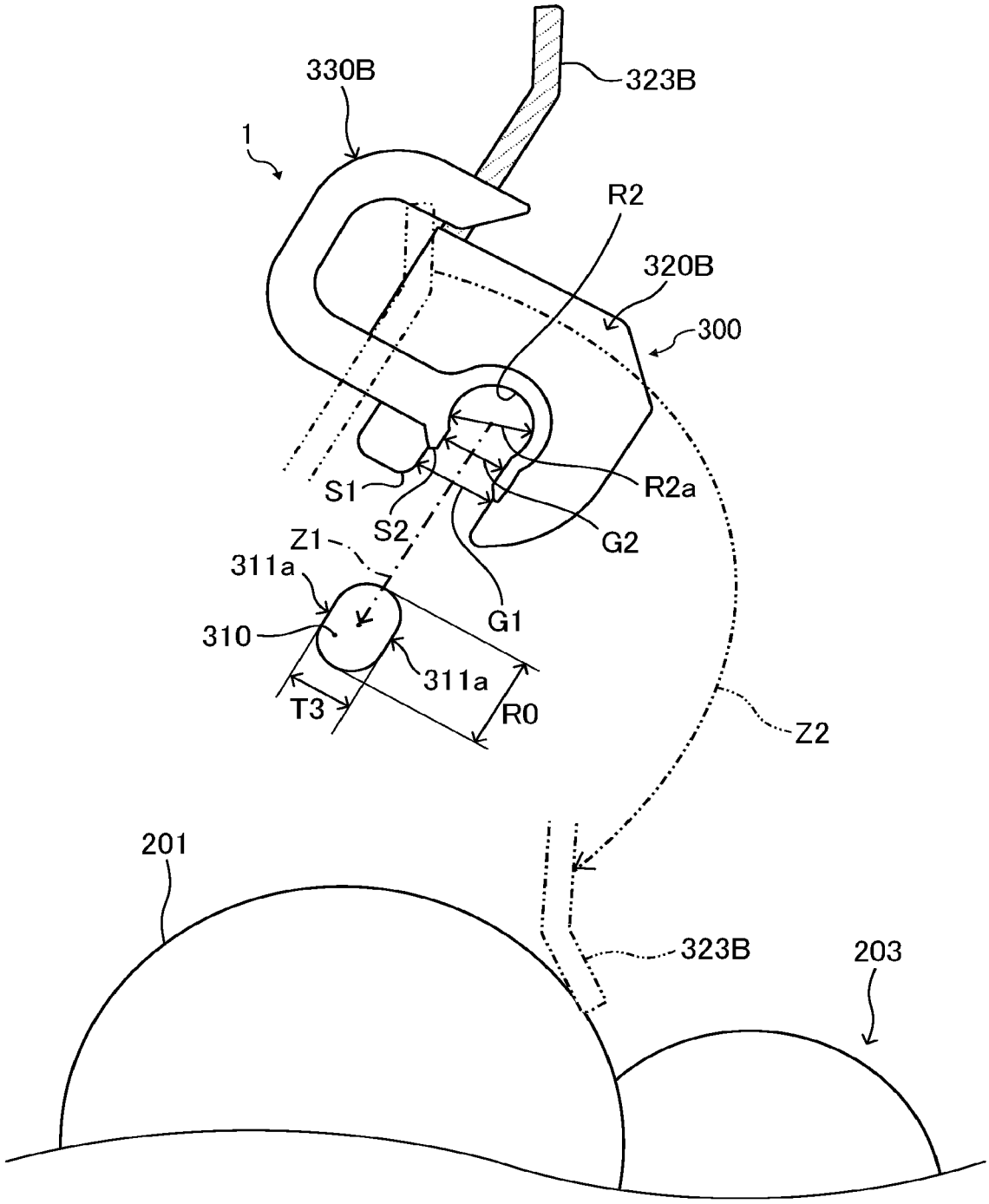
FIG. 8 is a diagram of a separator incorporating the separation plate depicted in FIG. 4, illustrating a process for installing the separation plate into the fixing device.

FIG. 8 is a diagram of the separator 1, illustrating processes for installing the separator 1 into the fixing device 200. FIG. 8 illustrates the separator 1 to be attached to the holding pin 310 of the fixing device 200 in a state in which the separation holder 330B is attached to the mount 320B, disposed at the rear of the fixing device 200, of the separation plate 300 such that rotation of the separation holder 330B is restricted. The holding pin 310 includes a decreased diameter portion having a decreased diameter T3 seen in a predetermined angular direction, for example, a direction Z1 in FIG. 8. The holding pin 310 has an increased diameter R0 seen in another angular direction that is different from the direction Z1. The increased diameter R0 is greater than the decreased diameter T3. At least one of the first slit S1 and the second slit S2 has a slit width (e.g., the width G1 or G2) that is smaller than the increased diameter R0 of the holding pin 310. For example, the holding pin 310 has a shape (e.g., an oval in cross section) produced by cutting a cylindrical pin at positions recessed from circumferential faces for an identical amount to create a pair of parallel planes 311*a* that are parallel to each other with a distance defined by the decreased diameter T3. The holding pin 310 is secured to a front face of the rear side plate 301 of the fixing device 200 depicted in FIG. 3 such that the parallel planes 311*a* are parallel to the direction Z1.

Rotation of the separation holder 330B is restricted such that the opposed faces of the first slit S1 of the mount 320B and the second slit S2 of the separation holder 330B are parallel to each other. In a state in which the opposed faces of the first slit S1 of the mount 320B and the opposed faces of the second slit S2 of the separation holder 330B are parallel to the direction Z1 in which the separation plate 300 and the separation holder 330B move, that is, in a state in which the second slit S2 overlaps the first slit S1, the separation plate 300 moves such that the holding pin 310 enters the second slit S2 of the separation holder 330B. Thus, the holding pin 310 is inserted into the second slit S2. When insertion of the holding pin 310 finishes, the separation plate 300 pivots in a direction Z2, bringing the contact portion 323B of the separation plate 300 into contact with an outer circumferential surface of the fixing belt 201. A portion of the fixing belt 201, that contacts the contact portion 323B of the separation plate 300, is supported by the flange that guides the inner circumferential surface of the fixing belt 201. When the separation plate 300 pivots in the direction Z2, a positional relation between the second slit S2 and the decreased diameter portion of the holding pin 310, that has the decreased diameter T3, that is, a positional relation between the second slit S2 and the parallel planes 311*a*, changes from that when the holding pin 310 enters the second slit S2. Accordingly, the separation plate 300 does not drop off and therefore does not fall down when the fixing device 200 is used.

A description is provided of a construction of a comparative fixing device.

The comparative fixing device employs an attachment as a separator supported by a holding shaft. The comparative fixing device includes a conductor serving as a supplemental member interposed between a pin and a through-hole. The pin serving as the holding shaft is mounted on a frame that supports the separator. The through-hole of a first hollow axial portion is disposed in a held portion of a separation plate of the separator. The conductor includes a hollow shaft serving as a second hollow axial portion that engages the through-hole of the first hollow axial portion of the separation plate. The hollow shaft also engages the pin mounted on the frame. The conductor further includes an arm including a boss that is coupled to the hollow shaft and contacts the separation plate to restrict pivoting of the separation plate about the hollow shaft. The conductor prevents a transfer electric current applied to a transfer portion from leaking to the separator through a recording medium, thus preventing faulty transfer such as a transfer spot.

However, the attachment is requested to improve work for attaching the attachment. Improvement of the work is not limited to the supplemental member to prevent faulty transfer such as the transfer spot.

In the comparative fixing device, the boss of the arm restricts rotation of the conductor with respect to the separation plate in a single direction. However, the boss does not restrict rotation of the conductor in other direction. To address this circumstance, an operator (e.g., a service engineer) installs the separator into the comparative fixing device to assemble the comparative fixing device while the operator holds the conductor with a jig, his or her fingers, or the like to prevent the conductor from rotating with respect to the separation plate and prevent a first slit and a second slit from shifting. Accordingly, improvement in installation of the separator is requested.

To address the circumstance of the comparative fixing device, in the fixing device 200 according to the embodiments of the present disclosure, rotation of the separation holders 330A and 330B with respect to the separation plate 300 are restricted in either direction (e.g., the forward direction and the backward direction). Accordingly, an operator (e.g., a service engineer) causes the holding pin 310 to enter the second slit S2 of each of the separation holders 330A and 330B readily with improved efficiency in work and assembly. If the operator presses each of the separation holders 330A and 330B to cause the holding pin 310 to enter the second slit S2 forcibly while the first slit S1 does not overlap the second slit S2, parts of the fixing device 200 may suffer from breakage. To address this circumstance, rotation of the separation holders 330A and 330B are restricted in both directions (e.g., the forward direction and the backward direction), reducing breakage of parts of the fixing device 200. Since the separation plate 300 restricts rotation of the separation holders 330A and 330B, the operator installs the separator 1 into the fixing device 200 with one hand while holding the fixing device 200 with another hand without paying attention to the separation holders 330A and 330B. Accordingly, the operator does not use a jig to secure the separator 1 to the fixing device 200, suppressing assembly costs.

A description is provided of a configuration of the cover 334 that is incorporated in each of the separation holders 330A and 330B and covers the periphery of the holding pin 310.

Figure 9A:
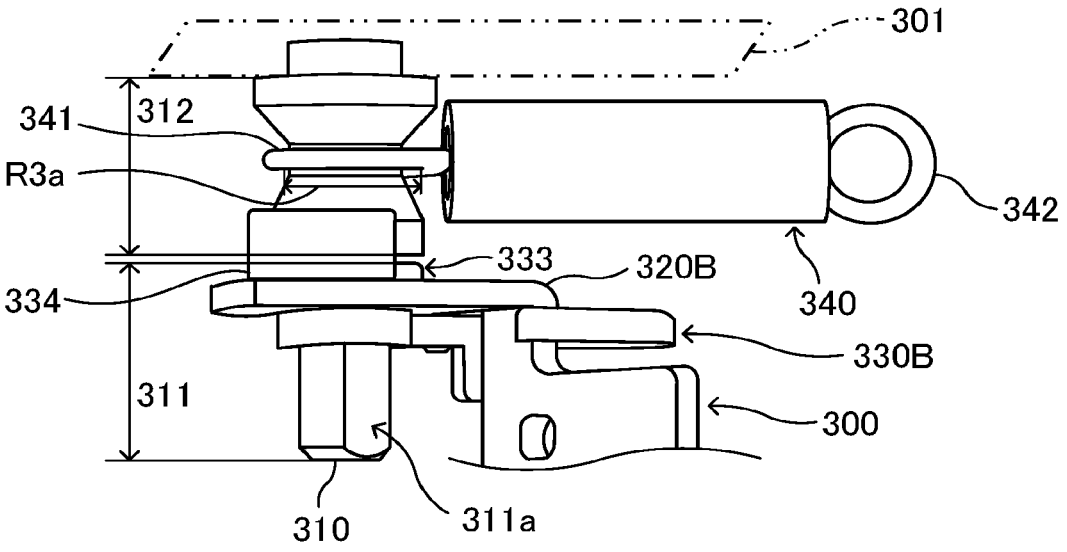
FIG. 9A is a side perspective view of a cover incorporated in the separation holder depicted in FIG. 7B.
Figure 9B:
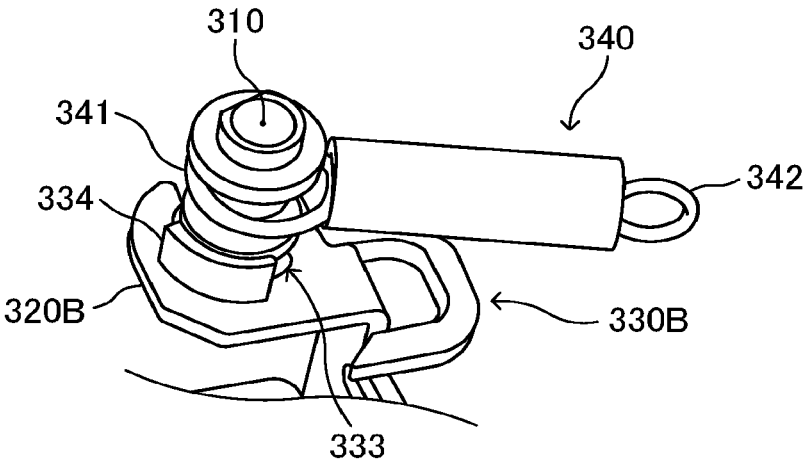
FIG. 9B is a top perspective view of the cover depicted in FIG. 9A.

FIGS. 9A and 9B illustrate the cover 334. FIG. 9A is a perspective view of the mount 320B and the separation holder 330B disposed at the rear of the fixing device 200, illustrating a vicinity of the mount 320B seen from below. FIG. 9B is a perspective view of the vicinity of the mount 320B.

As illustrated in FIG. 9A, the holding pin 310 includes a decreased diameter portion 311 having the parallel planes 311*a* at a tip of the holding pin 310 in a longitudinal direction thereof. The holding pin 310 further includes a base end 312 disposed in proximity to the rear side plate 301 of the fixing device 200. The base end 312 of the holding pin 310 engages one end 341 of a pressure spring 340 serving as a biasing member. Another end 342 of the pressure spring 340 engages a movable mount that holds the pressure roller 203 and is used to bias the pressure roller 203 against the fixing belt 201. The operator moves a pressure release lever to cancel a biasing force of the pressure spring 340 through a linkage mechanism. According to an example illustrated in FIGS. 9A and 9B, the linkage mechanism is configured to cause another end 342 of the pressure spring 340, that is disposed in proximity to the movable mount, to move toward the holding pin 310 when the operator moves the pressure release lever to release pressure from the pressure roller 203 to the fixing belt 201.

When the biasing force is canceled, for example, one end 341 of the pressure spring 340, that is disposed opposite the holding pin 310, may shift in an axial direction of the holding pin 310 (e.g., a vertical direction in FIG. 9A) or a spring portion of the pressure spring 340 may tilt. Without the cover 334, one end 341 having a ring shape may surmount a flange 333 projecting from a face of the mount 320B, that is disposed opposite the pressure spring 340, or may surmount or may be caught by other portion of the separation holder 330B or a part of the separation plate 300, even during a fixing process to fix a toner image on a recording medium S. Accordingly, failures below may occur.

For example, as the pressure spring 340 surmounts the separation plate 300, the separation holder 330B, and the like, a load imposed on the pressure roller 203 may vary between both lateral ends of the pressure roller 203 in an axial direction thereof. Accordingly, compression of the pressure roller 203 may change, varying the conveyance speed at which the pressure roller 203 conveys the recording medium S and therefore creasing the recording medium S. As the pressure spring 340 stretches beyond a designed level and increases the load, a load imposed on parts of the fixing device 200 may increase, causing degradation of the pressure roller 203 and early abrasion of slide members (e.g., the fixing belt 201 and the thermal equalizer 216) disposed inside the fixing device 200. Accordingly, failures such as faulty fixing, a folded edge of the recording medium S, and jamming of the recording medium S may occur even before the life of the fixing device 200 is exhausted.

To address this circumstance, the fixing device 200 according to the embodiments of the present disclosure includes the cover 334 that prevents the pressure spring 340 from surmounting the separation plate 300 and the separation holder 330B. As illustrated in FIG. 7B, the cover 334 includes an edge face 334*a* defined by an arc having an inner diameter R4*a* and an arc having an outer diameter R4*b*. As illustrated in FIG. 9A, the pressure spring 340 includes a ring disposed at one end of the pressure spring 340, that is disposed opposite the holding pin 310. The ring has an inner diameter R3*a*. The inner diameter R4*a* of the edge face 334*a* depicted in FIG. 7B is smaller than the inner diameter R3*a* of the ring. The outer diameter R4*b* of the edge face 334*a* depicted in FIG. 7B is greater than the inner diameter R3*a* of the ring. The edge face 334*a* prevents the pressure spring 340 from surmounting the separation plate 300 and the separation holder 330B.

The cover 334 may cover an entirety of the holding pin 310 for 360 degrees. According to an example depicted in FIG. 7B, the cover 334 covers about one quarter of a whole circumference of the holding pin 310. If the cover 334 is excessively small, the cover 334 may have a decreased mechanical strength and may suffer from an increased risk of breakage. Conversely, if the cover 334 is excessively great, the cover 334 may interfere with one end 341 of the pressure spring 340. In view of those circumstances, the cover 334 is produced to ensure the mechanical strength, avoid interference with the pressure spring 340, and reduce manufacturing costs by decreasing an amount of resin used to produce the cover 334.

Figure 10A:
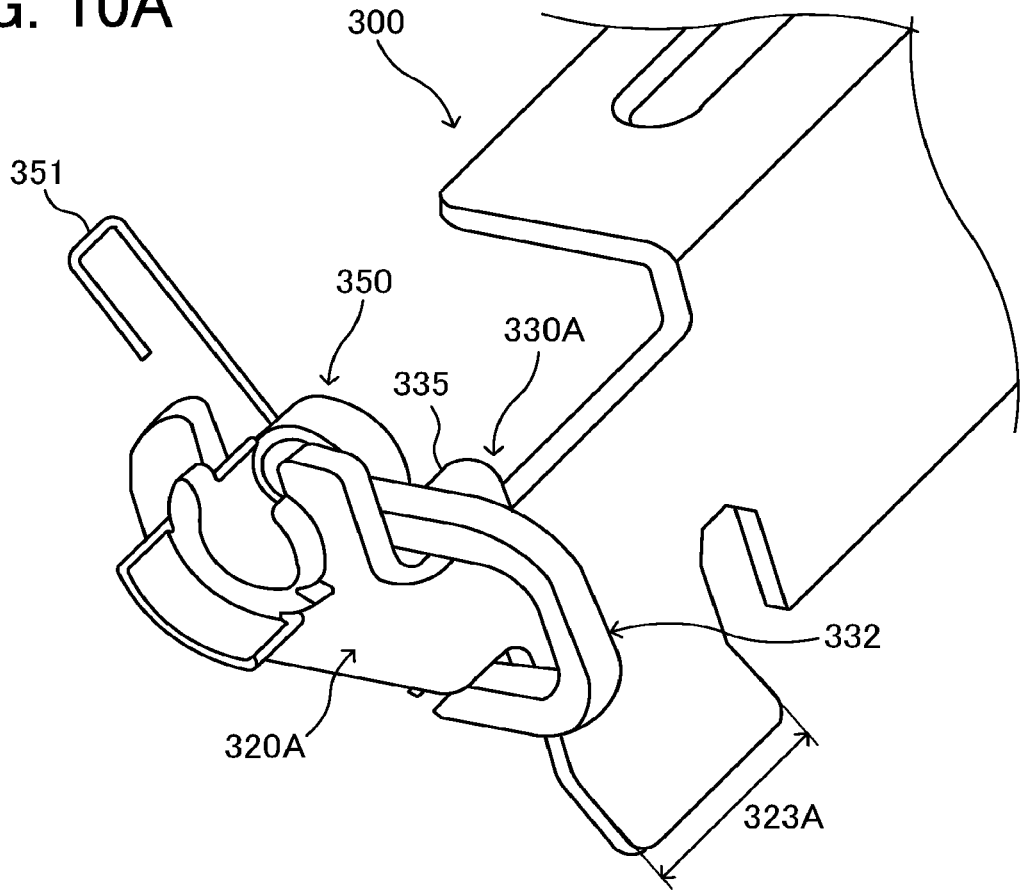
FIG. 10A is a perspective view of the vicinity of the mount depicted in FIG. 5, illustrating a biasing member that biases the separation plate depicted in FIG. 4.
Figure 10B:
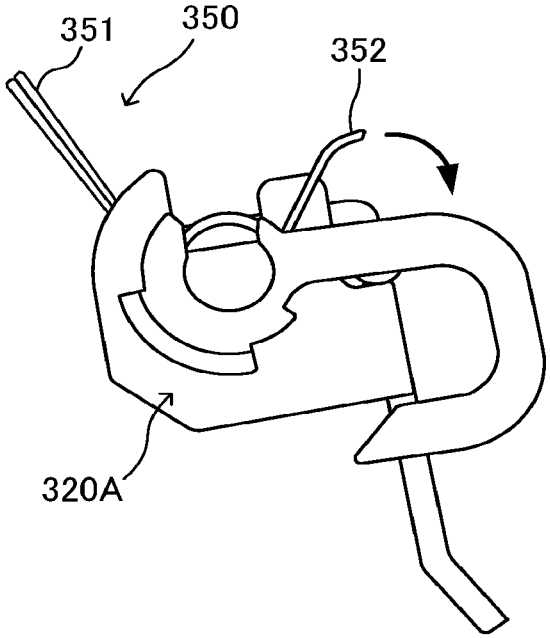
FIG. 10B is a front view of the vicinity of the mount depicted in FIG. 10A.

FIGS. 10A and 10B illustrate a biasing member that biases the separation plate 300. FIG. 10A is a perspective view of the vicinity of the mount 320A disposed at the front of the fixing device 200. FIG. 10B is a front view of the vicinity of the mount 320A. One end 351 of a coil spring 350 serving as a biasing member engages a predetermined position inside the fixing device 200. Another end 352 of the coil spring 350 contacts a spring abutment 335 mounted on the arm 332 of the separation holder 330A. Accordingly, the coil spring 350 biases the contact portion 323A, bringing the contact portion 323A into contact with the outer circumferential surface of the fixing belt 201.

In the fixing device 200 according to the embodiments described above, a holding pin (e.g., the holding pin 310) supports a separation plate (e.g., the separation plate 300) through a hollow shaft (e.g., the second hollow axial portion 331) of a separation holder (e.g., the separation holders 330A and 330B). The hollow shaft of the separation holder contacts the holding pin directly. The comparative fixing device has a construction below. For example, the frame is grounded electrically. The conductor has an electric resistance value that is greater than an electric resistance value of the frame. The conductor is interposed between a holding portion of the frame and the held portion of the separation plate. The separation plate achieves electrical continuity with the frame through the conductor. Contrarily to the construction of the comparative fixing device, the fixing device 200 according to the embodiments of the present disclosure includes the separation holders 330A and 330B each of which serves as a conductor, preventing faulty transfer such as a transfer spot.

If the separation holders 330A and 330B are used to achieve other objective, the separation holders 330A and 330B may not be conductive as described above. In the fixing device 200 according to the embodiments of the present disclosure, the second hollow axial portion 331 is disposed in the through-hole R1 of the first hollow axial portion 325. An inner circumferential surface of the second hollow axial portion 331 contacts an outer periphery of the holding shaft 310. Alternatively, in addition to the separation holders 330A and 330B, an inner face of the through-hole R1 of the first hollow axial portion 325 of the separation plate 300 may also contact the holding pin 310. Yet alternatively, the inner face of the through-hole R1 of the first hollow axial portion 325 of the separation plate 300 may solely contact the holding pin 310. In those cases also, a restrictor (e.g., the arm 332 and the coupler 324A) restricts relative rotation of a supplemental member (e.g., the separation holders 330A and 330B) in the forward direction and the backward direction in a state in which the first slit S1 and the second slit S2 receive a holding shaft (e.g., the holding pin 310), thus improving work of the operator to install the separation plate 300 into the fixing device 200.

A description is provided of advantages of an attachment (e.g., the separator 1).

As illustrated in FIGS. 3, 4, and 5, the attachment includes a first hollow axial portion (e.g., the first hollow axial portion 325) including a first slit (e.g., the first slit S1) that receives a holding shaft (e.g., the holding pin 310). The attachment is added with a supplemental member (e.g., the separation holders 330A and 330B). The supplemental member includes a second hollow axial portion (e.g., the second hollow axial portion 331) including a second slit (e.g., the second slit S2) that receives the holding shaft. The attachment further includes a restrictor (e.g., the arm 332 and the coupler 324A) that restricts relative rotation of the supplemental member in a forward direction and a backward direction in a state in which the first slit and the second slit receive the holding shaft (e.g., in a state in which the first slit and the second slit are ready to receive the holding shaft).

Accordingly, the attachment improves work of an operator who attaches the attachment.

According to the embodiments described above, the fixing belt 201 serves as a fixing rotator. Alternatively, a fixing roller, a fixing film, a fixing sleeve, or the like may be used as a fixing rotator. Further, the pressure roller 203 serves as a pressure rotator. Alternatively, a pressure belt or the like may be used as a pressure rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. An attachment configured to be attached to a holding shaft, the attachment comprising:

a first hollow axial portion including a first slit configured to receive the holding shaft;

a supplemental member including a second hollow axial portion including a second slit configured to receive the holding shaft, the supplemental member configured to rotate in a forward direction and a backward direction; and a restrictor, including an arm extending from the second hollow axial portion in a diametrical direction of the second hollow axial portion, and a coupler configured to engage a tip of the arm, to restrict rotation of the supplemental member in the forward direction and the backward direction in a state in which the first slit and the second slit receive the holding shaft.

2. The attachment according to claim 1,
wherein a slit width of the first slit is greater than a width of the arm.

3. The attachment according to claim 2, wherein the arm includes a first restricting portion, and a second restricting portion disposed opposite the first restricting portion; and
wherein the coupler is configured to be sandwiched between the first restricting portion and the second restricting portion.

4. The attachment according to claim 3, wherein the arm further includes a curved portion interposed between the first restricting portion and the second restricting portion.

5. The attachment according to claim 1, wherein the first hollow axial portion includes a bearing.

6. The attachment according to claim 1, wherein the second hollow axial portion includes a hollow shaft.

7. A fixing device, comprising:
a holding shaft; and
a separator configured to be supported by the holding shaft,
the separator including:
a first hollow axial portion including a first slit configured to receive the holding shaft;
a supplemental member including a second hollow axial portion including a second slit configured to receive the holding shaft, the supplemental member configured to rotate in a forward direction and a backward direction, wherein the second hollow axial portion is disposed in the first hollow axial portion; and
a restrictor configured to restrict rotation of the supplemental member in the forward direction and the backward direction in a state in which the first slit and the second slit receive the holding shaft.

8. The attachment of claim 1, wherein the second hollow axial portion is disposed inside the first hollow axial portion.

9. The fixing device according to claim 7,
wherein the holding shaft has a decreased diameter in a first direction and an increased diameter in a second direction that is different from the first direction, the increased diameter being greater than the decreased diameter, and
wherein at least one of the first slit and the second slit has a slit width that is smaller than the increased diameter of the holding shaft.

10. The fixing device according to claim 7,
wherein an inner circumferential surface of the second hollow axial portion is configured to contact an outer periphery of the holding shaft.

11. The fixing device according to claim 7, wherein the supplemental member further includes a cover configured to cover a periphery of the holding shaft.

12. The fixing device according to claim 7,
wherein the supplemental member is configured to rotate to cause the second slit to overlap the first slit, and
wherein the holding shaft is configured to enter the second slit.

13. The fixing device according to claim 7, further comprising a rotator over which a recording medium is conveyed,
wherein the separator further includes a separation plate disposed opposite the rotator, the separation plate configured to separate the recording medium from the rotator, and
wherein the supplemental member further includes a separation holder configured to support the separation plate.

14. The fixing device according to claim 13, wherein the rotator includes a fixing belt.

15. The fixing device according to claim 13, wherein the first hollow axial portion is disposed in the separation plate.

16. The fixing device according to claim 13,
wherein the separator further includes a coil spring configured to bias the separation plate,
wherein the restrictor includes an arm extending from the second hollow axial portion in a diametrical direction of the second hollow axial portion, and
wherein the separation holder includes a spring abutment mounted on the arm and configured to contact the coil spring.

17. An image forming apparatus, comprising:
an image bearer configured to bear an image; and
a fixing device configured to fix the image on a recording medium, the fixing device including:
a holding shaft; and
a separator configured to be supported by the holding shaft, the separator including:
a first hollow axial portion including a first slit configured to receive the holding shaft;
a supplemental member including a second hollow axial portion including a second slit configured to receive the holding shaft, the supplemental member configured to rotate in a forward direction and a backward direction; and
a restrictor, including an arm extending from the second hollow axial portion in a diametrical direction of the second hollow axial portion, and a coupler configured to engage a tip of the arm, to restrict rotation of the supplemental member in the forward direction and the backward direction in a state in which the first slit and the second slit receive the holding shaft.

18. The image forming apparatus of claim 17, wherein the second hollow axial portion is disposed inside the first hollow axial portion.

19. An attachment configured to be attached to a holding shaft, the attachment comprising:
a first hollow axial portion including a first slit configured to receive the holding shaft;
a supplemental member including a second hollow axial portion including a second slit configured to receive the holding shaft, the supplemental member configured to rotate in a forward direction and a backward direction; and
a restrictor, including an arm extending from the second hollow axial portion in a diametrical direction of the second hollow axial portion, wherein the arm includes a first restricting portion, and a second restricting portion disposed opposite the first restricting portion,
wherein the restrictor further includes a coupler configured to be sandwiched between the first restricting portion and the second restricting portion to restrict rotation of the supplemental member in the forward direction and the backward direction in a state in which the first slit and the second slit receive the holding shaft.

* * * * *